US005104112A

United States Patent [19]

Briggs et al.

[11] Patent Number: 5,104,112

[45] Date of Patent: Apr. 14, 1992

[54] DOCUMENT FEEDER HAVING REVERSIBLY POSITIONED DIRECT DRIVE SEPARATOR ASSEMBLY MOTOR

[75] Inventors: Francis J. Briggs, Bethel; Joseph H. Marzullo, Brookfield; Roderick N. Schmaling, Brookfield Center, all of Conn.

[73] Assignee: Pitney Bowes Inc., Stamford, Conn.

[21] Appl. No.: 617,238

[22] Filed: Nov. 21, 1990

[51] Int. Cl.[5] ..... B65H 3/52; B65H 3/06

[52] U.S. Cl. ..... 271/121; 271/117

[58] Field of Search ..... 271/109, 117, 121, 124, 271/125

[56] References Cited

U.S. PATENT DOCUMENTS

| | | | |
|---|---|---|---|
| 2,608,286 | 11/1949 | Henschker . | |
| 2,660,431 | 11/1953 | Levin . | |
| 2,808,260 | 10/1957 | Rünzi | 271/125 |
| 3,382,964 | 7/1968 | Bonhoff et al. . | |
| 3,484,099 | 12/1969 | Gallagher | 271/125 |
| 3,966,191 | 6/1976 | Strobel | 271/125 |
| 4,061,329 | 12/1977 | Sachuk . | |
| 4,121,089 | 10/1978 | Bishop . | |
| 4,248,415 | 2/1981 | Steihilber . | |
| 4,501,417 | 2/1985 | Foster et al. | 271/124 |
| 4,526,358 | 7/1985 | Ura et al. | 271/125 |
| 4,548,397 | 10/1985 | Rünzi | 271/125 |
| 4,597,694 | 10/1986 | Huber . | |
| 4,603,848 | 8/1986 | Markgraf et al. | 271/125 |
| 4,635,922 | 1/1987 | Roetter et al. | 271/121 |
| 4,651,983 | 3/1987 | Long | 271/125 |
| 4,798,374 | 1/1989 | Ito . | |
| 4,822,019 | 4/1989 | Nagira . | |
| 4,850,580 | 7/1989 | Denzin et al. | 271/121 |
| 5,006,903 | 4/1991 | Stearns | 271/125 |

FOREIGN PATENT DOCUMENTS

| | | | |
|---|---|---|---|
| 1-192631 | 8/1989 | Japan | 271/121 |

*Primary Examiner*—Robert P. Olszewski
*Assistant Examiner*—Steven M. Reiss
*Attorney, Agent, or Firm*—Charles R. Malandra, Jr.; David E. Pitchenik; Melvin J. Scolnick

[57] ABSTRACT

The present invention is embodied in an inserting machine which feeds documents, inserts and envelopes. The sheet feeder comprises a frame, including a feed deck for holding a stack of sheets to be fed; and a separator wheel assembly, including at least one separator wheel, adjustably mounted to the frame above the feed deck. A motor is mounted adjacent to the wheel assembly for directly driving the separator wheel. Separator means for cooperating with the separator wheel assembly to restrict the feeding to single sheets is mounted to the frame opposite the separator wheel assembly and extends in-part above the feed deck. In another embodiment of the present invention, the direct drive motor is positionable on either side of the separator wheel assembly for achieving offset feeding adjustments of the separator wheel assembly. In a further embodiment of the present invention, the separator wheel assembly is spring biased for adjusting its position above the feed deck by means an indexing wheel to a position commensurate with the characteristics of the material being fed.

16 Claims, 5 Drawing Sheets

DOCUMENT FEEDER HAVING REVERSIBLY POSITIONED DIRECT DRIVE SEPARATOR ASSEMBLY MOTOR

RELATED APPLICATIONS

The following pending related applications refer to the subject matter of this application:

U.S. application Ser. No. 07/616,263, filed Nov. 20, 1990.

U.S. application Ser. No. 07/615,561, filed Nov. 19, 1990.

FIELD OF INVENTION

This invention relates to an improved separator assembly for document feeders and particularly to separator assemblies for document feeders used in feeder modules in a multiple module document inserting machine.

BACKGROUND OF THE INVENTION

In the art of feeding documents, it is known to use interference separation in a feeder including separator wheels rotating in conjunction with a fixed stone for the purpose of feeding documents seriatim from a stack. In known inserters, the driving mechanism for such feeders generally has been a friction drive situated on the outside of the paper path of the inserter. Typically, the friction drives are operatively connected to and driven by the main drive assemblies of the inserter, and are controlled through the use of various clutch mechanisms. An example of such a feeder is described in U.S. Pat. No. 2,762,623 issued Sept. 11, 1956 to Uthenwoldt, et al. and assigned to the assignee of the present invention. Generally, the gear and clutch arrangement for such friction drives comprises a substantial number of parts. Over time, normal wear and tear on the friction drives parts causes them to exceed required tolerances for the operation of the machine which then requires service replacement of the worn parts. Furthermore, because such friction drives are located outside the paper path, the inserter size or "footprint" must include the additional area to house the cluster of shafts, clutches and gears which comprise the friction drives.

The insert feeder must also accommodate offset feeding adjustments as described, for example, in U.S. Pat. No. 4,501,417, issued Feb. 26, 1985 to Foster, et al. and assigned to the assignee of the present invention, U.S. Pat. No. 4,501,417 also describes apparatus to adjust the bite between the separator wheels and the stone. The method of adjustment taught by Foster, et al. comprises adjusting the separator stone and shield relative to a stationary separator wheel. Generally, a shield between in stone and the separator wheel is also adjusted to limit the amount of stone exposed to the separator wheels. Although the adjustments to the stone and shield work satisfactorily, several trial and error adjustments to the stone and shield are necessary in setting up the feeder for each type of document being fed. Another type of adjustment, as described in U.S. Pat. No. 4,782,095, issued Mar. 1, 1988 to Irvine, et al and assigned to the assignee of the present invention, comprises adjusting the separator roller relative to a retarding roller. U.S. Pat. No. 4,582,313, also assigned to assignee of present invention, shows an adjustment of a separator roller relative to a separator stone. Although these adjustment devices work satisfactorily, each time a change is made with regard to the characteristics of the document being fed, the trial and error adjustment begins all over because there is no reference from one adjustment to the next.

SUMMARY OF THE INVENTION

It has been found that the size, complexity and number of parts for a sheet feeder are reduced significantly by using a motor mounted above the feed path for directly driving the separator wheel assembly. However, mounting the motor directly to the separator wheel assembly presents an obstruction in positioning the separator wheel assembly for offset feeding. It has been found that the problem of obstruction caused by the motor can be overcome by providing means for reversibly mounting the motor to the separator wheel assembly. In addition, a feeder having a separator wheel assembly directly driven by a motor mounted above the feed deck can be used to feed both enclosures and envelopes even when the envelopes are fed in the opposite direction from which the enclosures are fed.

It has also been found that the use of an indexing wheel for the bite adjustment between a spring biased separator wheel and a separator stone simplifies the adjustments required for handling different types of material being fed.

The present invention is embodied in an inserting machine which feeds documents, inserts and envelopes. The sheet feeder comprises a frame, including a feed deck for holding a stack of sheets to be fed; and a separator wheel assembly, including at least one separator wheel, adjustably mounted to the frame above the feed deck. A motor is mounted adjacent to the wheel assembly for directly driving the separator wheel. Separator means for cooperating with the separator wheel assembly to restrict the feeding to single sheets is mounted to the frame opposite the separator wheel assembly and extends in-part above the feed deck.

In another embodiment of the present invention, the direct drive motor is positionable on either side of the separator wheel assembly for achieving offset feeding adjustments of the separator wheel assembly.

In a further embodiment of the present invention, the separator wheel assembly is spring biased for adjusting its position above the feed deck by means an indexing wheel to a position commensurate with the characteristics of the material being fed.

BRIEF DESCRIPTION OF THE DRAWINGS

Further features and advantages of the apparatus in accordance with the invention will be clearly seen and more easily understood from the description of the figures wherein.

DETAILED DESCRIPTION OF THE PREFERRED EMBODIMENTS

Figure 1:
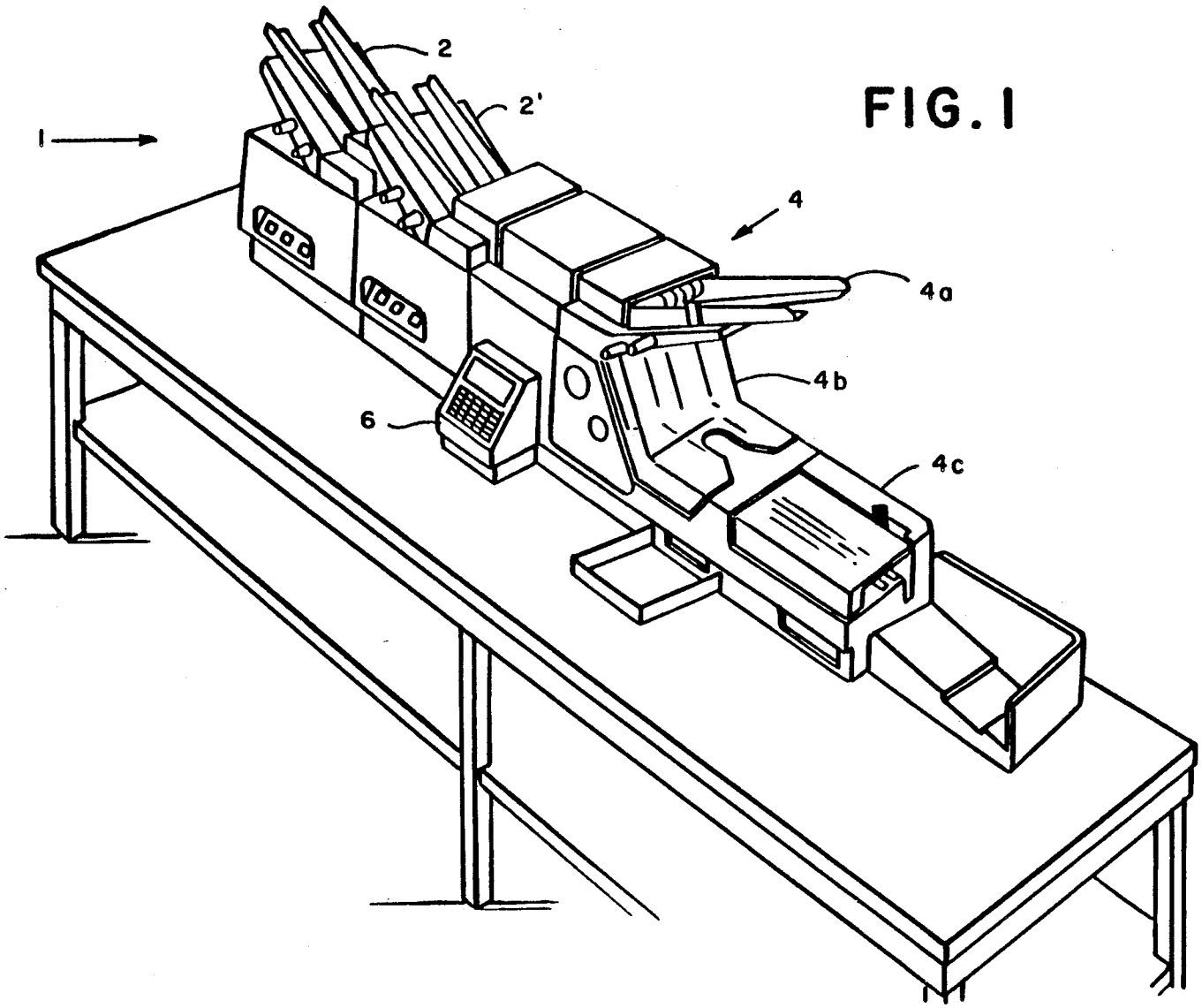
FIG. 1 is a perspective view of a table top inserter in which the present invention may be used.

Referring now in detail to the drawings, in FIG. 1 there is shown an example of a modular table top inserter 1 in which the present invention may be used. The inserter includes two feeder modules 2 and 2', and a base unit module 4 which includes an envelope feeder 4*a*, insert station 4*b* and a moistener and sealer station 4*c*. The base station also includes a control panel 6. Such an inserter is described in more detail in U.S. Pat. No. 4,942,535, issued July 17, 1990 to Robert Francisco and assigned to the assignee of the present invention.

Figures 2, 6:
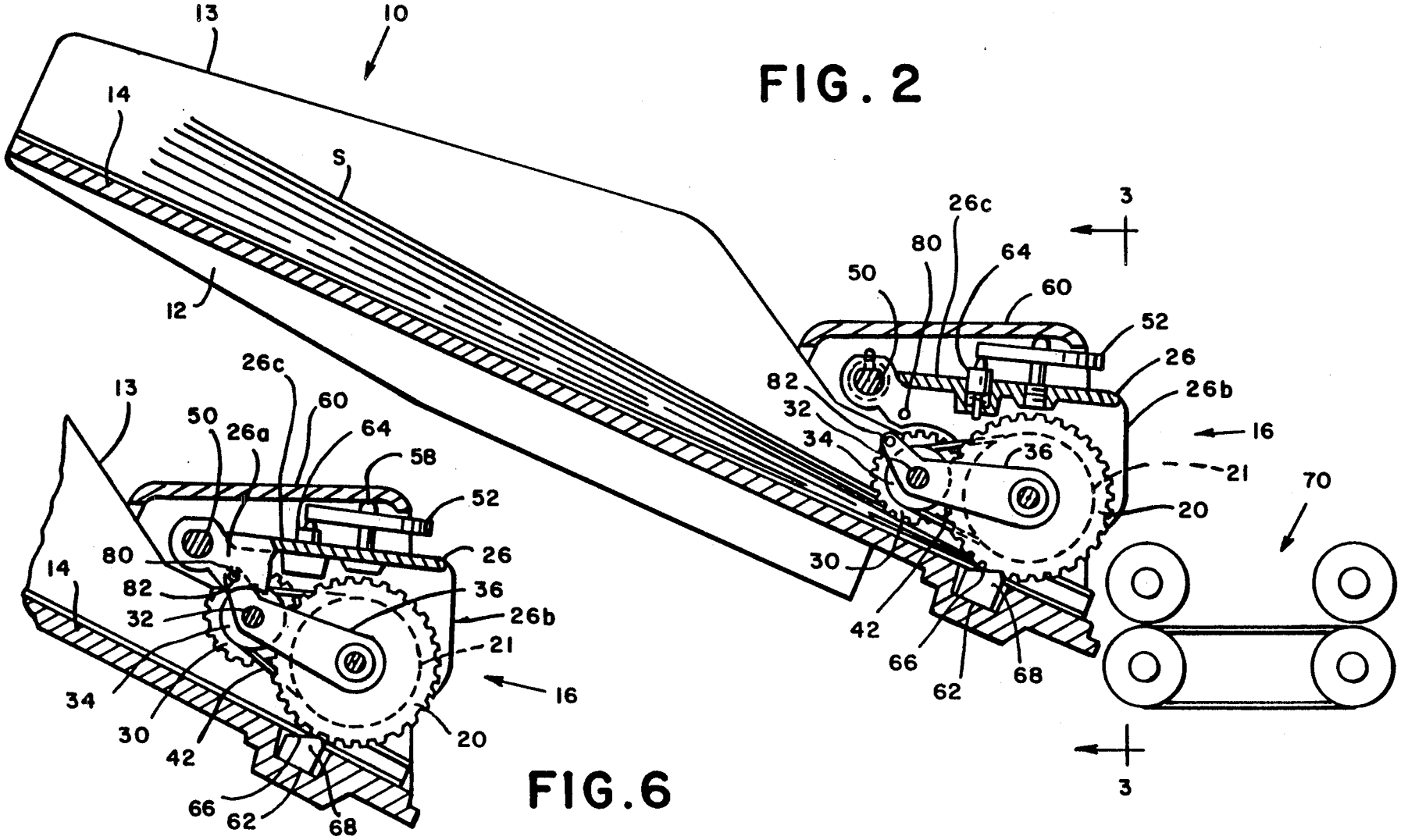
FIG. 2 is side view of an embodiment of the document feeder or the present invention.
FIG. 6 is a side view of the separator wheel housing portion of the document feeder in FIG. 2, showing the separator wheel access mechanism.
Figure 3:
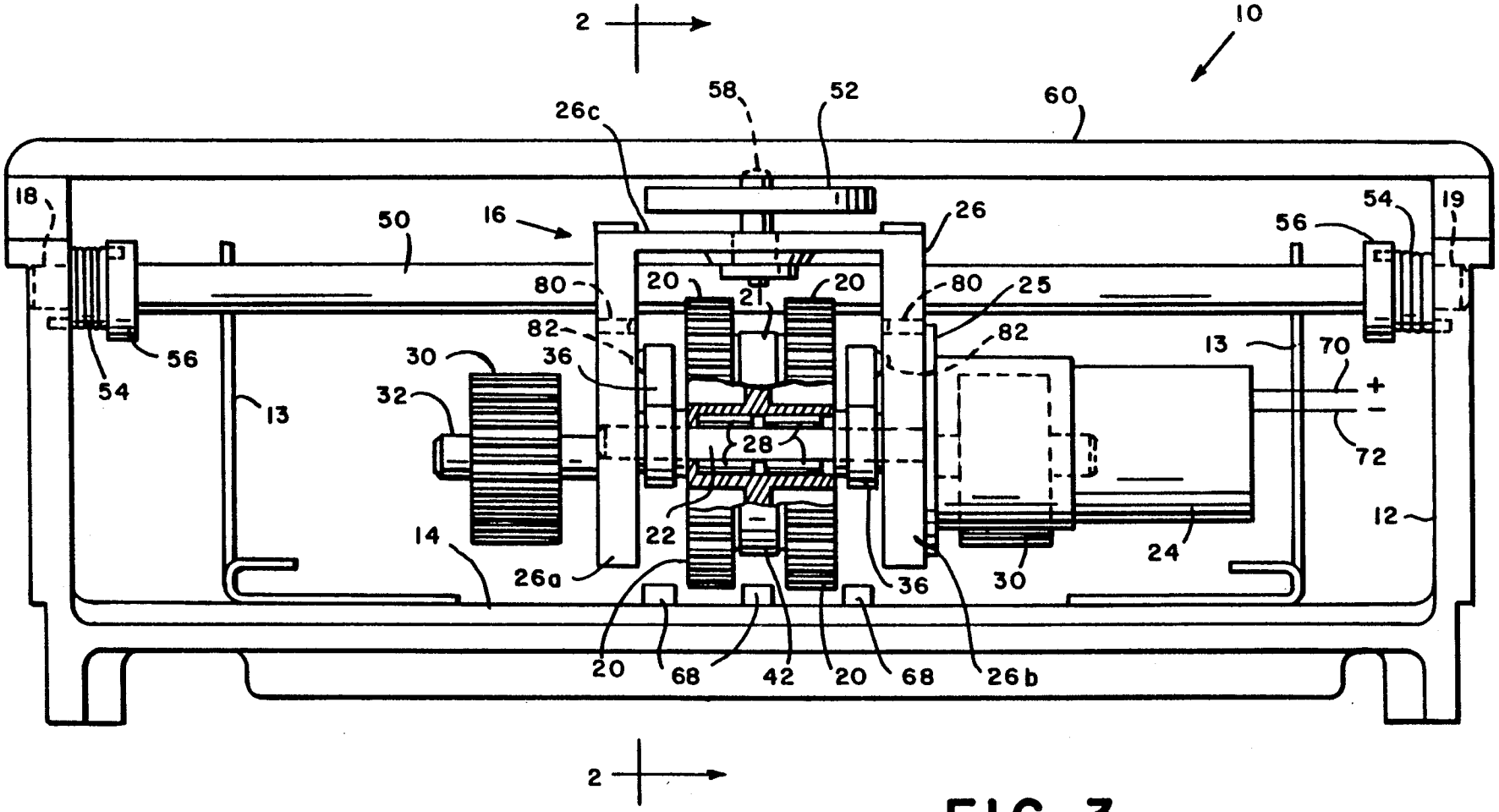
FIG. 3 is a front view, partly cutaway, of the document feeder in FIG. 2 with the motor mounted on the right side of the separator assembly.

In FIGS. 2 and 3 there is shown document feeder 10, having document support frame 12. In an inserter, a typical feeder frame would include several parts assembled together to make the frame. In the preferred embodiment of the present invention, the frame 12 is one piece, molded of a suitable plastic material, thereby eliminating the assembly and adjustment of parts required for a typical frame. An example of the plastic material used to mold the frame is polycarbonite foam such Lexan fl-913 as manufactured by General Electric of Fairfield, Conn. The frame 12 includes a feed deck 14 on which a supply of sheets or envelopes may be stacked. Attached to from 12 are two side guides 13. In accordance with the invention, separator wheel assembly 16, further described below, is pivotably mounted to the frame at 18 and 19.

In operation, the feeder 10 separates and feeds individual sheets or envelopes from their stacks at the separator wheel assembly 16. The sheets or envelopes are then transported along a transport pathway for further processing in the inserter.

Figure 4:
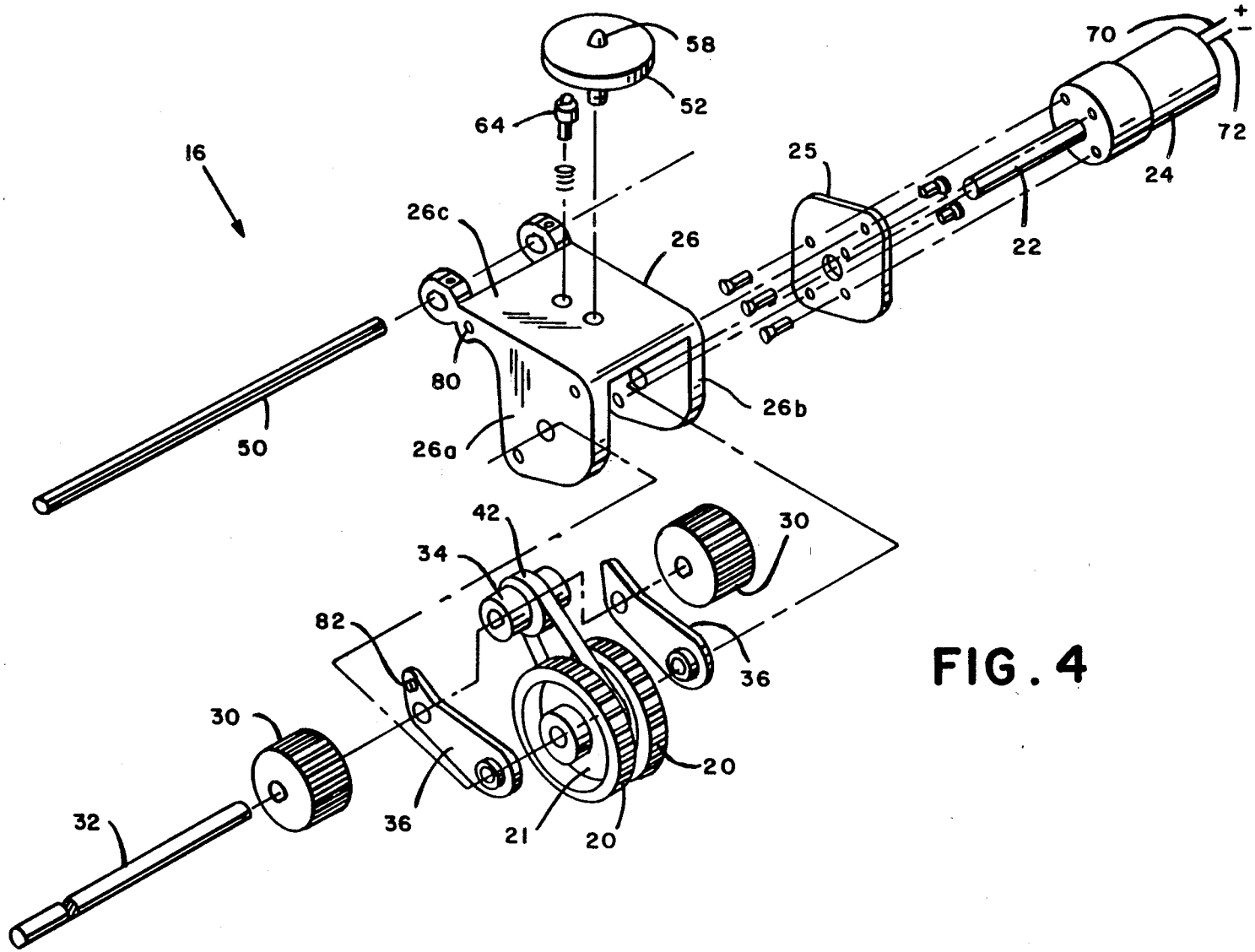
FIG. 4 is an exploded view of the separator assembly of the feeder in FIG. 3.

Referring now to FIG. 4, an exploded view of the separator wheel assembly 16 is shown. In the preferred embodiment of the present invention, the separator wheel assembly 16 comprises two separator wheels 20 each mounted to a hub 21. The hub 21 is carried by an output drive shaft 22 of motor 24, which shaft fits through an aperture in the hub 21. The motor 24 is a small DC motor of conventional design, such as DC motor part No. 415A153 manufactured by Globe Motors of Dayton, Ohio. The motor 24 has two electrical leads 70 and 72. In FIG. 3, lead 70 is the positive lead connected to a voltage source and lead 72 is the negative lead connected to a voltage return. The motor 24 is mounted to plate 25 which in turn is mounted to housing 26. The housing 26 is U-shaped, comprising two side panels 26*a* and 26*b* and top panel 26*c*, to provide a symmetrical support for the motor shaft 22 and the separator wheels 20. It has been found that the symmetrical shape of housing 26 provides a means for mounting motor 24 on either side of housing 26, further described below. The motor shaft 22 is suitably journaled through the side panels 26*a* and 26*b*. One-way clutch bearings 28 seated between the aperture in the hub 21 and the motor shaft 22 allow the separator wheels 20 to freely rotate on the shaft 22 in one direction (counter-clockwise as viewed from FIG. 2) and prevent slippage in the other direction.

Two pairs of prefeed wheels 30 are mounted on a prefeed shaft 32 which is driven by prefeed hub 34. The shaft 32 is supported on each side of hub 34 by one end of two support arms 36. The other end of each of the support arms 36 is pivotably attached to the respective sides of the aperture in the separator wheel hub 21. Timing belt 42 is used to engage the notched pulley sections of hubs 21 and 34 to drive prefeed wheel hub 34 when the separator wheel hub 21 is directly driven by motor shaft 22. It has been found that a timing belt is preferable to an O-ring for driving the prefeed rollers because of the amount of drive load associated with feeding documents and envelopes in the feeder 10 which caused the O-ring to slip. The separator wheels 20, as well as prefeed wheels 30, may be formed of any suitable material having a relatively high coefficient of friction such as urethane. It has been found desirable to employ one pair of prefeed wheels on the prefeed shaft 32 in conjunction with two separator wheels 20, however, other suitable combinations can be used as desired.

Referring again to FIGS. 2 and 3, the housing 26 is rigidly mounted to a shaft 50 in a known manner, for example, by set screws (not shown). An indexing wheel 52, including a nipple 58 centered on the top of the wheel, is adjustably mounted to the top of the housing 26 in a suitable manner such that indexing wheel 52 is lowered, for example on threads, to the top of the housing 26 when the wheel 52 is turned in one direction and is raised when turned in the other direction. The shaft 50 is suitably journaled to the sides of the frame 12 at 18 and 19. The entire separator wheel assembly 16 pivots about the shaft 50 to an adjustment position commensurate for the type of material being fed. A pair of springs 54 and collars 56 are used to bias the shaft 50 and separator wheel assembly 16 in a counter-clockwise direction, as viewed from FIG. 2, such that the nipple 58 rests against a bridge 60 which is rigidly mounted to the frame 12 and positioned above the separator wheel assembly 16.

In setting up the feeder, the separator wheel assembly 16 is lowered or raised by the rotation of the indexing wheel 52. The shaft 50, being predisposed to rotate counterclockwise by springs 54, forces the nipple 58 against the bridge 60. The rotation of the indexing wheel 52 lowers or raises the separator wheels 20 to achieve the bite adjustment between the separator wheels 20 and separator stone 62. The underside of the indexing wheel 52 contains a plurality of grooves. A plunger 64 is mounted on the top of the housing 26 and is spring biased against the grooves on the indexing wheel 52 to provide detent action when the indexing wheel 52 is rotated. In the preferred embodiment of the present invention, the top surface of the indexing wheel 52 has numbers or marks around the perimeter for reference in the adjustment of the positioning of separator wheels 20. It has been found that the detent action of the indexing wheel 52 and plunger 64 along with the reference marks on the indexing wheel 52 simplifies the bite adjustment by the operator.

The separator stone 62 is adjustably secured to the frame so that the stone 62 can be laterally positioned under the separator wheels 20. The stone 62 extends through a slot in the frame 12. A shield 66 is formed of a sheet of resilient material, such as stainless steel or the like. Adjacent the forward end of the shield 66, a plurality of fingers 68 of the stone 62 extend through feed deck 14. The shield 66 and stone fingers 68 are in fixed spatial relationship to one another. In the preferred embodiment of the present invention, the stone 62 has three fingers to achieve the interference separation with the two separator wheels 20.

In the preferred embodiment of the present invention, the size of the separator wheel hub 21 is larger than the prefeed wheel hub 34 such that the separator wheels 20 rotate at a slightly higher peripheral speed than prefeed wheels 30. This relationship allows the prefeed wheels 30 to feed the sheet (or envelope) on the feed deck 14 at a slightly slower speed than the sheet is fed by the separator wheels 20. This prevents the prefeed operation from interfering with the separator wheel operation. In the preferred embodiment of the present invention, the sizes of hubs 21 and 34 are such that the pre-feed wheels 30 rotate about twelve percent slower then the separator wheels 20.

Typically, the take away transport, to which sheets or envelopes are fed, operates at a higher speed than the feeder rollers. In the preferred embodiment of the present invention, the downstream transport belt assembly rollers 70, which are not part of the feeder 10, operate approximately three times the speed of the separator wheels, e.g., advancing sheets at 76 inches/sec. versus 25 inches/second.

In operation, sheets 5 are stacked on the feed deck 14 of the feeder 10 The motor 24 is energized causing prefeed wheels 30 and separator wheels 20 to rotate. The top sheet of the stack of sheets S is engaged by prefeed wheels 30 and is fed to separator wheels 20 which then feeds the sheet to transport belt assembly 70. As the trailing edge of the sheet passes by the prefeed wheels the next sheet is engaged by the prefeed wheels 30.

Although the prefeed wheels 30 are driven at slower speed than the separator wheels 20, it will be understood by those skilled in the art that when a sheet is engaged by the separator wheels 20 the separator wheels take over the feeding of the sheet, i.e., effectively yanking the sheet from under the prefeed rollers. This is typical for interference type separator assemblies. It will also be understood that when the leading edge of the sheet is engaged by the downstream belt assembly 70, the assembly 70 will effectively yank the sheet away from the separator wheels 20. The one way clutch bearing 28 allow the separator wheels to rotate freely as the transport 70, operating at a higher speed, takes control of the sheet.

Figure 5:
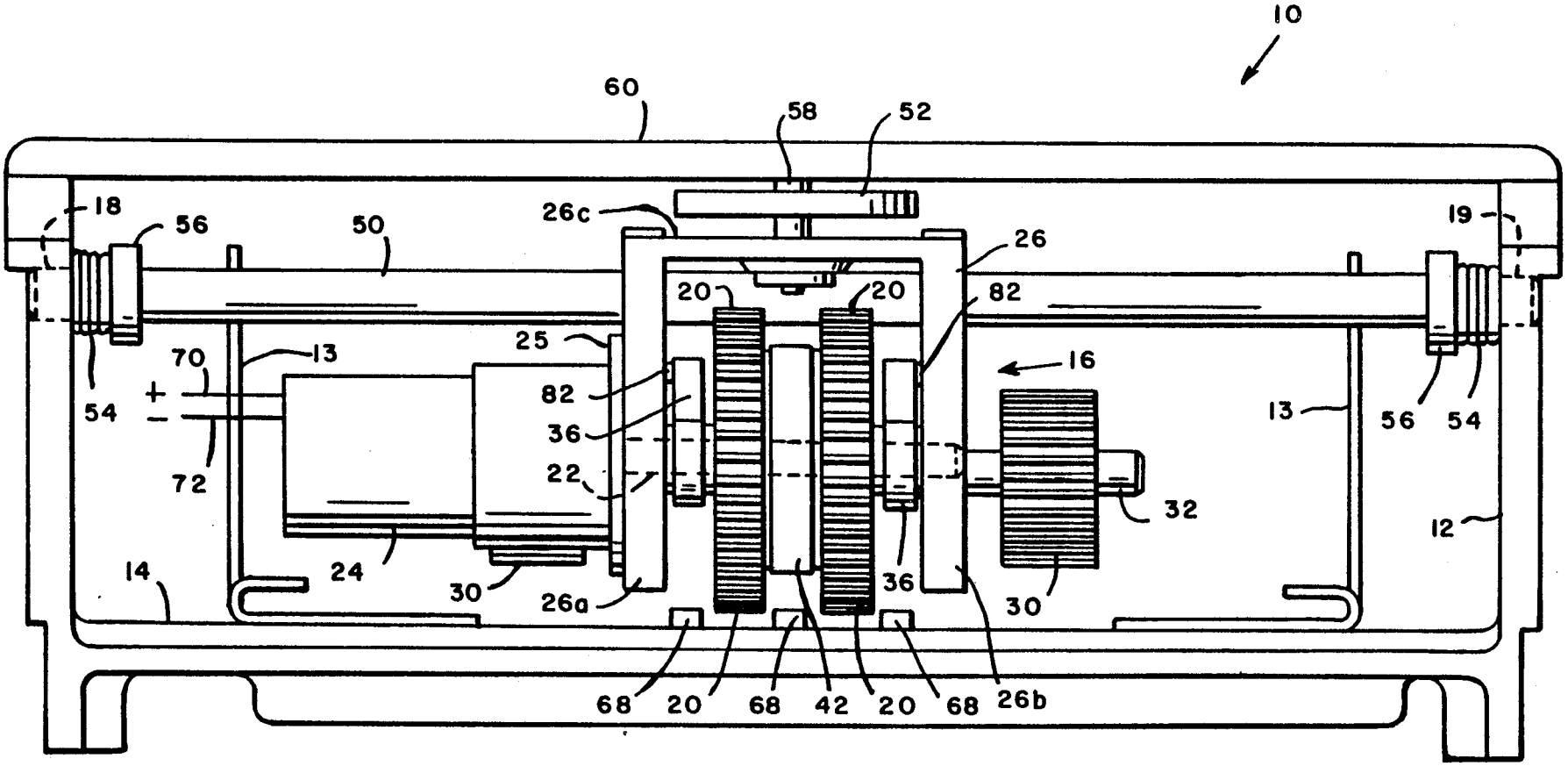
FIG. 5 is a front view of the document feeder in FIG. 2 with the motor mounted on the left side of the separator wheel housing.

In U.S. Pat. No. 4,501,417, supra, lateral positioning of a feed wheel and prefeed wheel assembly for handling offset feeding is described. If it is desired to offset the separator wheel assembly 16 in the present invention, the set screws (not shown) used in rigidly mounting housing 26 to shaft 50 are loosened and the assembly 16 is laterally positioned along shaft 50 as required for the particular offset feeding. It will be seen that in such an arrangement, motor 24 mounted to the separator wheel assembly 16 interferes with the lateral positioning of the separator wheel assembly 16 when certain offset feeding is required. It will be appreciated that, as seen in FIG. 3, the separator wheel assembly 16 can be offset a full range to the left, but only a limited range to the right because of the motor mounted to the assembly 16. It has been found in the present invention that the symmetrical shape of the separator wheel assembly allows the motor to be mounted on either side of the assembly. It has also been found that moving the motor to the other side of the separator wheel assembly 16 and reversing the electrical leads 70 and 72 of the motor allows the assembly 16 to be offset the full range to the right of center without effecting the performance or operation of the feeder. Lead 70 is now connected to the return and lead 72 is connected to the voltage source. This is shown in FIG. 5. It will be understood that reversibly mounting the motor to alternate sides of the assembly is only for allowing full range of offset feed adjustments and does not change the operation or performance of the feeder in any way. It will be further understood that the separator stone 62 must be suitably positioned to cooperate with the separator wheel assembly in the interference separation of the sheets.

Referring now to FIG. 6, there is shown a separator wheel access mechanism including two locking detents 80 situated in the separator wheel housing 26 and a locking detail 82 in each of the prefeed support arms 36. Each of the locking details 82 can be locked into the corresponding detent 80 by manually lifting the support arms 36 until the locking details 82 lock into the detents 80. It has been found that this separator wheel access mechanism provides advantages in several operational activities in the feeder, including document/envelope set-up, document detector set-up and test, and document/envelope jam clearing. The support arms 36 can be manually unlocked when the desired operation is completed. Since the prefeed support arms pivot at separator wheel hub 21 and are free floating, or if desired spring loaded at the prefeed hub end, it will be understood that use of this separator wheel access mechanism does not effect any adjustments previously made to the separator wheels.

It is known to have the same feeder for feeding envelopes and enclosures wherein the feed path for both are in the same direction. However, when the envelopes are fed in the opposite direction from which the enclosures are fed, special provisions must be made concerning the feeding of envelopes. Generally, the envelope feeder in such an inserter is either dedicated to feeding envelopes and differs from the enclosure feeders, or if similar to the enclosure feeder, it has a separate friction drive on the opposite side from the drive for the enclosure feeder. An example of the latter feeder is shown is U.S. Pat. No. 4,728,095, supra.

It has been found that the present invention can be used in an inserter to feed both enclosures and envelopes even when the envelopes are fed in the opposite direction that the enclosures are fed. It will be appreciated by those skilled in the art that the present invention eliminates the need for a dedicated envelope feeder or a separate friction drive for an envelope feeder in an inserter which is feeding envelopes in the opposite direction to the enclosures. The gearless, direct drive feeder of the present invention can be mounted to feed in any direction in an inserter without concern of drive trains and gear arrangements.

It will be appreciated by those skilled in the art that there has now been disclosed a novel document feeder including a reversibly positioned motor for directly driving the separator assembly. While this invention has been described in conjunction with specific embodiments thereof, many alternatives, modifications and variations will be apparent to those skilled in the art. Accordingly, it is intended to embrace all such alternatives, modifications and variations that follow within the spirit and scope of the appended claims.

What is claimed is:

1. In an inserter system, a sheet feeder for feeding individual sheets of material, said sheets including documents, inserts and envelopes, comprising:

a. a frame, said frame including a feed deck for holding a stack of sheets to be fed;

b. a separator wheel assembly adjustably mounted to said frame above said feed deck, said separator wheel assembly including at least one separator wheel mounted to a hub;

c. a motor mounted to said separator wheel assembly, said motor including an output drive shaft extending from one end of said motor into said separator wheel assembly, said hub being affixed to said drive shaft, said motor directly driving said separator wheel upon rotation of said drive shaft, wherein said motor drives the feeder independently from other drive means in the inserter; and d. separator means for cooperating with said separator wheel assembly to restrict feeding to single sheets from the stack of sheets, said separator means mounted to said frame opposite said separator wheel assembly and extending in part above said feed deck.

2. The feeder in accordance with claim 1 wherein said frame is a one piece molded plastic construction.

3. The feeder in accordance with claim 1 wherein said separator wheel assembly further comprises a plurality of prefeed wheels disposed upstream from said separator wheel.

4. The feeder in accordance with claim 1 wherein the motor is controlled by a control means of the inserter separately from other motors or drive means in the inserter.

5. A feeder as set forth in claim 1 wherein said separator means comprises: a separator stone having a plurality of fingers extending in part through said feed deck.

6. A feeder as set forth in claim 1 wherein said separator wheel assembly includes: a housing mounted to said frame, said motor mounted to one side of said housing, said housing having at least one aperture through which said drive shaft of said motor drives said separator wheel; and further comprises vertical adjustment means mounted to said housing for adjusting the spacing between said separator wheel assembly and said separator means.

7. A feeder in accordance with claim 6, wherein said vertical adjustment means comprises an indexing wheel adjustably mounted to the top of said housing, said indexing wheel including a knob projecting against a bridge disposed above said separator assembly, said separator assembly being spring biased against said bridge whereby rotating said indexing wheel in one direction lowers said indexing wheel to said housing thereby raising said separator wheel assembly, and rotating said indexing wheel in the opposite direction raises said indexing wheel above said housing thereby lowering said separator wheel assembly.

8. The feeder in accordance with claim 1, wherein the feeder is mountable on the inserter in a first position for feeding the sheets from said feed deck in a first direction, and wherein the feeder is mountable on the inserter in a second position for feeding the sheets from said feed deck in a second direction, said second direction being reverse to said first direction.

9. The feeder in accordance with claim 1 wherein said separator wheel assembly includes a housing having first and second sides, said motor being normally mountable to said first side and being reversibly mountable to said second side, said motor having electrical leads that are connected to a power source in a first manner when said motor is mounted to said first side of said housing and are reversibly connected to a power source when said motor is reversibly mounted to said second side of said housing.

10. A sheet feeder for a document processing machine, comprising:

a. a frame including a feed deck for supporting a stack of documents;

b. separator means mounted to said frame and adjustably positioned transversely to the feed deck for feeding said documents seriatim from said stack, said separator means including a separator assembly with at least one separator roller;

c. a motor disposed adjacent to said separator assembly for directly driving said separator rollers, said motor having a drive shaft which carries said separator roller, whereby said separator roller is directly driven by said motor; and d. mounting means for mounting said motor, said mounting means being adapted such that said motor is positionable on either side of said separator assembly for allowing offset feeding adjustments of said separator means in either direction.

11. The feeder in accordance with claim 10 wherein the separator assembly further includes prefeed wheels positioned upstream from said separator roller and driven by the rotation of the said separator rollers.

12. The feeder in accordance with claim 10 wherein the separator assembly is affixed to a shaft, said shaft being mounted transversely to the frame whereby said separator assembly is adjustably positionable along said shaft to achieve offset feeding of sheets.

13. The feeder in accordance with claim 12 wherein said separator assembly further includes a housing covering said separator roller, said motor being mounted to a first side of said housing for center feeding and certain offset feeding, and is mounted to a second side of said housing when the first side mounting of said motor interferes with other offset feeding.

14. In an inserter, a sheet feeding device comprising:

a feed deck;

a separator wheel assembly adjustably mounted above said feed deck, said separator wheel assembly including at least one separator wheel;

a motor;

mounting means for mounting said motor on either side of said wheel assembly, and means for coupling said motor directly to said separator wheel by a drive shaft for driving said separator wheel;

first adjustment means coupled to said separator wheel assembly for adjustably positioning said separator wheel assembly transversely along said feed deck, whereby said motor can be mounted to the other side of said separator wheel assembly so that said separator wheel assembly can be transversely positioned anywhere along said feed deck; and second adjustment means coupled to said separator wheel assembly for adjustably positioning said separator wheel assembly to a position above said feed deck commensurate with the type of material being fed.

15. A sheet feeder for a document processing machine, comprising:

a. a frame including a feed deck for supporting a plurality of documents;

b. a separator stone having a plurality of fingers extending through said feed deck; and c. a separator assembly adjustably secured to a rotatable shaft journaled to said frame and disposed above said feed deck for feeding documents seriatim from said feed deck, said separator assembly including:

i. at least one separator wheel mounted on separator hub in opposing spaced relationship to said separator stone, said opposing spaced relationship establishing a bite between said separator wheel and said separator stone. said separator wheel being operative upon rotation for feeding documents through said bite;

ii. a housing secured at one end to said rotatable shaft, said housing being symmetrically shaped and having two side portions and a top portion;

iii. a motor secured at a first side of said housing, said motor having a drive shaft extending through an aperture in said housing, said separator wheel affixed to said drive shaft, said motor being operative upon rotation of said drive shaft for driving said separator wheel;

iv. a plurality of prefeed wheels disposed adjacent to and upstream from said separator wheel, said prefeed wheels affixed to prefeed shaft mounted on a prefeed hub, said prefeed shaft supported by one end of a pair of support arms, the other end of said support arms rotably mounted to said separator hub;

v. a timing belt coupled to said separator hub and said prefeed hub, said timing belt being operative upon rotation of said separator hub for driving said prefeed hub; and vi. an indexing wheel adjustably mounted on top of said housing, said indexing wheel including a knob projecting from the top of said indexing wheel, said rotatable shaft being spring biased causing said housing to rotate upwards until said knob is pressed against a bottom side of a bridge disposed over said housing, whereby said bite between said separator wheel and said separator stone can be adjusted by turning said indexing wheel in one direction to raise said separator wheel and in another direction to lower said separator wheel.

16. The sheet feeder in accordance with claim 15, wherein said separator assembly is transversely positionable along said rotatable shaft for offset feeding of the documents and wherein said motor can be secured to a second side of said housing, said electrical wires of said motor being reversed to drive said separator rollers in a forward direction.

* * * * *